US006842957B2

(12) United States Patent
Van Giezen

(10) Patent No.: US 6,842,957 B2
(45) Date of Patent: Jan. 18, 2005

(54) PROCESS FOR PRODUCING A TUBULAR COMPONENT

(75) Inventor: Maurice Gerardus Maria Van Giezen, Vogelenzang (NL)

(73) Assignee: Corus Staal BV, CA Ijmuiden (NL)

( * ) Notice: Subject to any disclaimer, the term of this patent is extended or adjusted under 35 U.S.C. 154(b) by 0 days.

(21) Appl. No.: 10/240,543

(22) PCT Filed: Apr. 2, 2001

(86) PCT No.: PCT/EP01/04070

§ 371 (c)(1),
(2), (4) Date: Mar. 12, 2003

(87) PCT Pub. No.: WO01/74507

PCT Pub. Date: Oct. 11, 2001

(65) Prior Publication Data

US 2003/0159289 A1 Aug. 28, 2003

(30) Foreign Application Priority Data

Apr. 3, 2000 (NL) ..... 1014823

(51) Int. Cl.[7] ..... B23P 17/00; B21J 5/04

(52) U.S. Cl. ..... 29/421.1; 29/897.2; 72/56; 72/61; 138/171; 228/147

(58) Field of Search ..... 29/421.1, 897.2; 72/54, 56, 58, 59, 61; 219/121.63; 138/171, 155; 228/147

(56) References Cited

U.S. PATENT DOCUMENTS 3,452,424 A * 7/1969 Morris ..... 228/147
4,603,806 A 8/1986 Watanabe et al.
4,839,496 A * 6/1989 Armier et al. ..... 219/121.63
5,662,145 A * 9/1997 Stagg ..... 138/171
6,216,509 B1 4/2001 Lotspaih et al.
2003/0127149 A1 * 7/2003 Ooyauchi et al. ..... 138/177

FOREIGN PATENT DOCUMENTS

| | | |
|---|---|---|
| DE | 198 31 047 A1 * | 1/1999 |
| DE | 19802685 | 7/1999 |
| EP | 0869265 | 10/1998 |
| IT | 1257248 | 1/1996 |
| JP | 3291115 | 12/1991 |
| WO | 0010748 | 3/2000 |

OTHER PUBLICATIONS

Definition of "Trapezium", Mathworld, http://mathworld-.wolfram.com/Trapezium.html.*

* cited by examiner

*Primary Examiner*—Marc Jimenez
(74) *Attorney, Agent, or Firm*—Stevens, Davis, Miller & Mosher, LLP

(57) ABSTRACT

Process for producing a tubular component which comprises sections which are intentionally different from one another with regard to one or more aspects selected from the group consisting of aspects including material, thickness, size, more specifically circumference or diameter, and the like, and hydroforming of the component, in which process the component is produced by rolling up a substantially flat sheet, which flat sheet substantially corresponds to a flat blank of the tubular component.

15 Claims, 6 Drawing Sheets

PROCESS FOR PRODUCING A TUBULAR COMPONENT

BACKGROUND OF THE INVENTION

The invention relates to a process for producing a tubular component which comprises sections which are intentionally different from one another with regard to one or more aspects selected from the group consisting of aspects including material, thickness, size, more specifically circumference or diameter, and the like, and hydroforming of the component.

A known method for (de)forming tubular components is the method known as hydroforming. In this method, the wall of a section of pipe is pressed against a shaped part or die under the influence of, for example, water pressure. The hydroforming technique is generally known and therefore requires no further explanation here. If the section of pipe is also to be bent, a bending action is carried out prior to and separately from the hydroforming, the bent section of pipe then being provided with the ultimately desired shape by hydroforming. In this way, it is possible to make numerous very complicated shapes which are used in engineering, for example in the automotive industry.

Furthermore, it is known that it is possible to make the component to be hydroformed particularly suitable for certain applications by making the component not from a section of pipe of uniform cross section and wall thickness, but rather assembling the section of pipe from various pipe elements which adjoin one another, are to be welded to one another and have, for example, wall thicknesses which (locally) differ from one another and/or a change in diameter. Pipe sections of this pipe are also known as "tailored tubular blanks".

SUMMARY OF THE INVENTION

It is an object of the invention to provide another method for producing tailored tubular blanks of this type.

Process for producing a tubular component which comprises sections which are intentionally different from one another with regard to one or more aspects selected from the group consisting of aspects including material, thickness, size, more specifically circumference or diameter, and the like, and hydroforming of the component, in which process the component is produced by rolling up a substantially flat sheet, which flat sheet substantially corresponds to a flat blank of the tubular component.

BRIEF DESCRIPTION OF THE DRAWINGS

The invention will now be explained with reference to the drawing, in which.

Expression for an automotive part

DETAILED DESCRIPTION OF THE PREFERRED EMBODIMENTS

The present invention relates to a process for producing a tubular component having over at least part of its length a widening or tapering section, comprising the steps of:

joining together flat sheet parts which differ from one another, at least one of the sheet parts being trapezium-shaped, bringing together opposite edges of the joined sheet parts bringing together opposite edges of the joined sheet parts and joining the edges in such a manner that the tubular component formed in this way can be hydroformed, and hydroforming the component.

In the process referred to in the preamble, this is achieved by the fact that the component is produced by rolling up a substantially flat sheet, which flat sheet substantially corresponds to a flat blank of the tubular component.

In the context of the present application, the term rolling up is to be understood as meaning bringing together opposite edges of the sheet, in any suitable way, and joining these edges in such a manner that the tubular component formed in this way can be hydroformed.

In this way, by starting from flat tailored blanks which are easy to make and rolling them up in order to convert them into tailored tubular blanks, it is possible to produce tubular components which can be successively hydroformed, for example a B pillar of an automobile made by hydroforming of a trumpet-shaped tube section which is made from a flat sheet part which has been cut in such a manner that it is in the form of a rectangle and trapezium which have been placed against one another.

In particular, according to the invention the procedure is such that the flat sheet is obtained by joining together sheet parts which differ from one another.

In doing so, it is possible to provide one part of the section of pipe, for example the part which is derived from the abovementioned rectangle, with a thickness which is different from that of another part, for example the part which is derived from the abovementioned trapezium.

According to one embodiment, the joining is laser welding.

By laser welding, it is possible to produce a join which is such that the component can be hydroformed without problems.

Furthermore, there are advantages if a joining seam between the sheet parts which is formed by joining runs in such a manner that an angle (see, for example angle "A" of the embodiment of FIG. 15) which is included between an imaginary line through the start and end of the joining seam and the axis "L" about which it has been rolled is not zero.

This results in the joining seam between sheet parts and a joining seam for continuing the pipe section after it has been rolled up not intersecting one another at one point and thus not excessively weakening the pipe section at that point.

Figure 11:
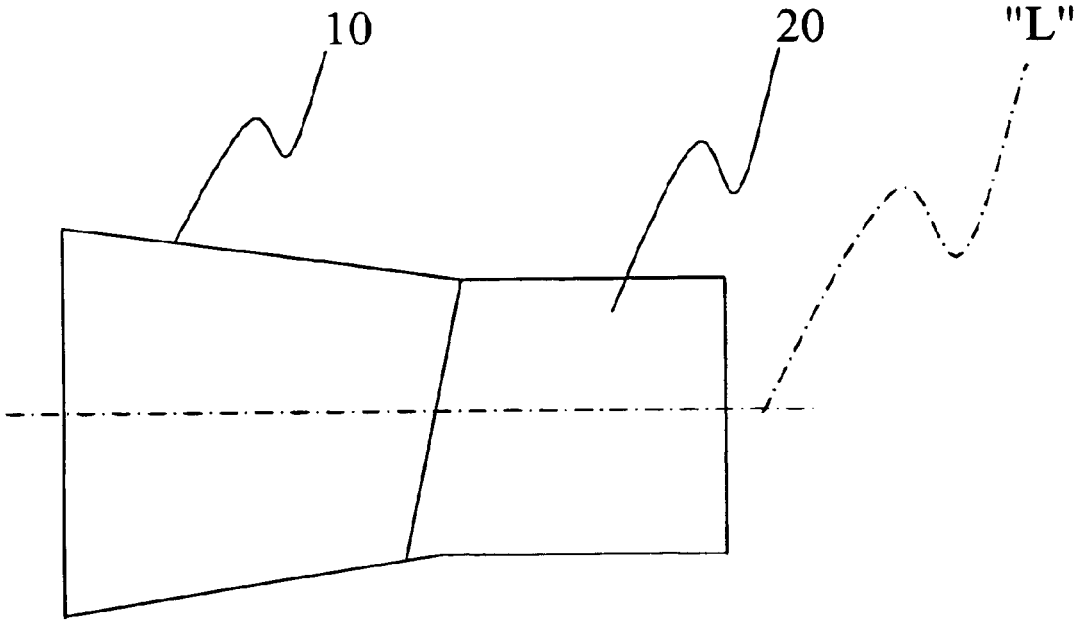
FIG. 11 shows top view of an embodiment of the joined flat sheet parts having a trapezium with no parallel sides prior to bringing together opposite edges of the joined sheet parts and joining the edges.
Figure 12:
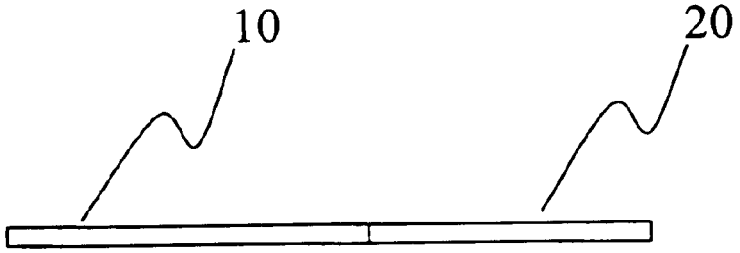
FIG. 12 shows a side view of the embodiment of FIG. 11.

This is illustrated by FIGS. 11 and 12 which show an embodiment of the joined flat sheet parts 10, 20 prior to bringing together opposite edges of the joined sheet parts and joining the edges. The dashed line "L" represents the axis about which the sheet parts 10, 20 are rolled.

Figure 13:
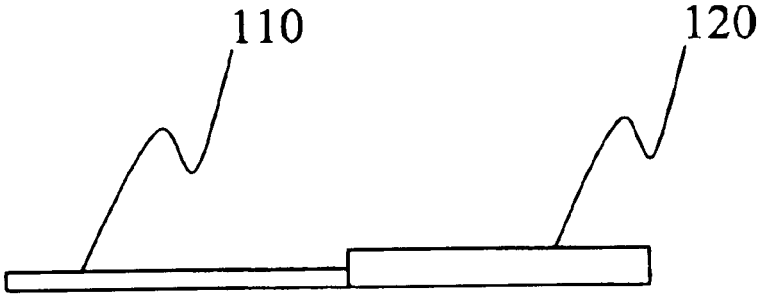
FIG. 13 shows a side view of an embodiment which is the same as that of FIG. 12 except that one joined part is thicker than another joined part.

FIG. 13 shows a modified embodiment having joined flat sheet parts 110, 120 prior to bringing together opposite edges of the joined sheet parts and joining the edges, wherein the parts 110, 120 have different thicknesses.

Figure 14:
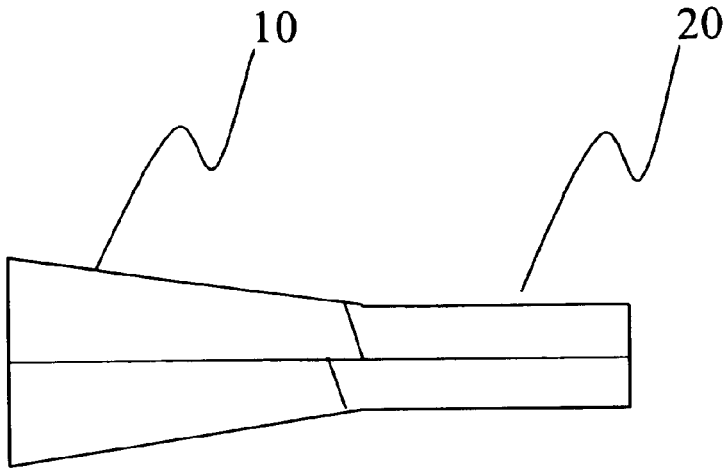
FIG. 14 shows the product of bringing together opposite edges of the joined sheet parts and joining the edges for the embodiment of FIG. 11.

Bringing together opposite edges of the joined sheet parts 10, 20 and joining the edges for the embodiment of FIG. 11 results in the structure shown by FIG. 14.

Figure 15:
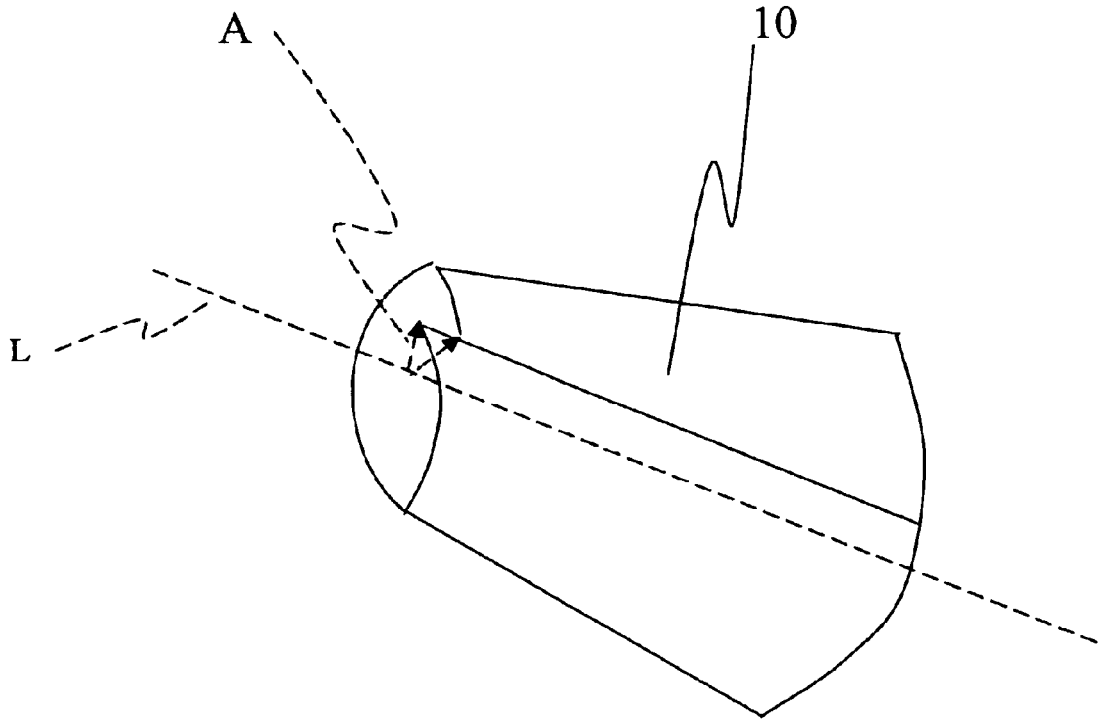
FIG. 15 shows the trapezium-shaped portion of the embodiment of FIG. 11 after rolling.

After rolling, a non-zero degree angle forms by drawing the angle "A" from the starting point of the first seam to a point on the axis and then from that point on the axis to the end point of the first seam as shown by the arrows in FIG. 15 for the trapezium portion 10 of the embodiment of FIG. 11.

Figure 16:
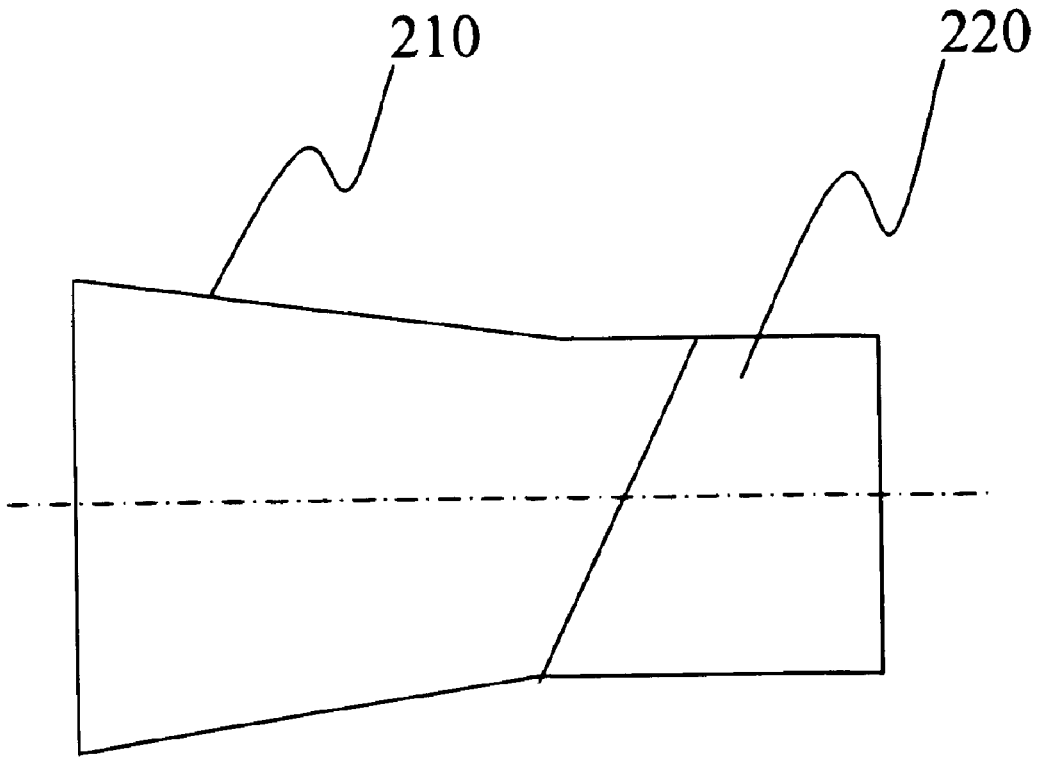
FIG. 16 shows top view of another embodiment of the joined flat sheet parts having a trapezium with two parallel sides prior to bringing together opposite edges of the joined sheet parts and joining the edges.

FIG. 16 shows another embodiment of the joined flat sheet parts 210, 220 prior to bringing together opposite edges of the joined sheet parts and joining the edges. The dashed line "L" represents the axis about which the sheet parts 210, 220 are rolled.

Figure 17:
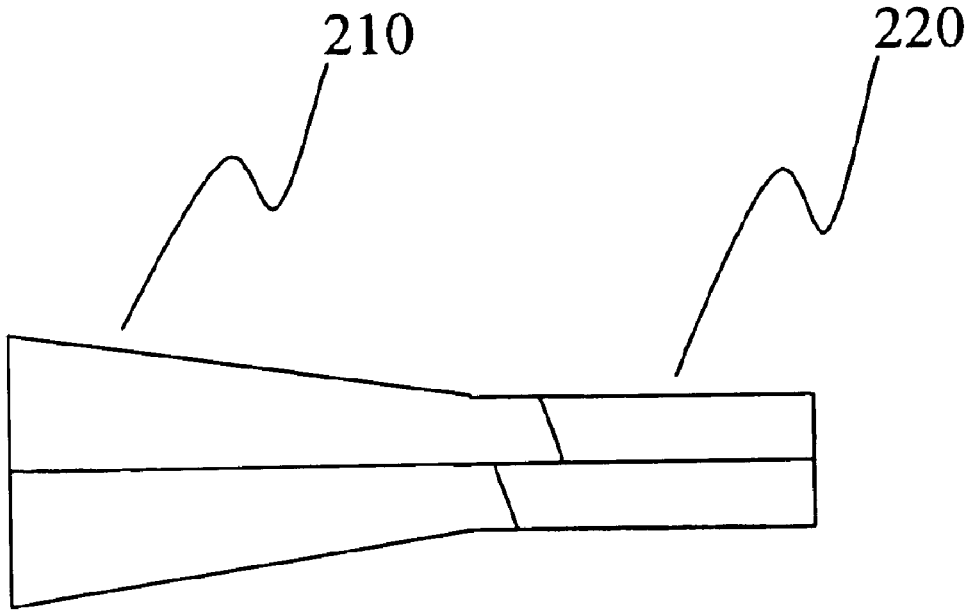
FIG. 17 shows the product of bringing together opposite edges of the joined sheet parts and joining the edges for the embodiment of FIG. 11.

FIG. 17 shows the the joined flat sheet parts 210, 220 after bringing together opposite edges of the joined sheet parts and joining the edges.

Figure 18:
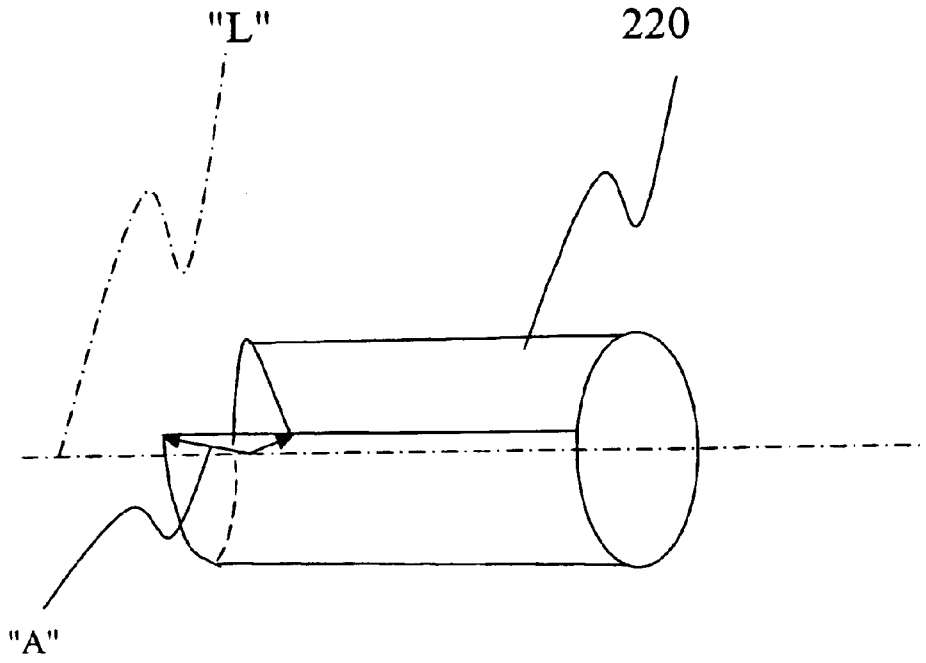
FIG. 18 shows the trapezium-shaped portion of the embodiment of FIG. 16 after rolling.

After rolling, a non-zero degree angle forms by drawing the angle "A" from the starting point of the first seam to a point on the axis and then from that point on the axis to the end point of the first seam as shown by the arrows in FIG. 18 for the trapezium portion 220 of the embodiment of FIG. 16.

In the embodiment of the present invention, the sheet parts which differ from one another include a trapezium-shaped sheet part.

The rolled-up pipe section then has a tapering or widening section, depending on the orientation of the trapezium.

Figure 1:
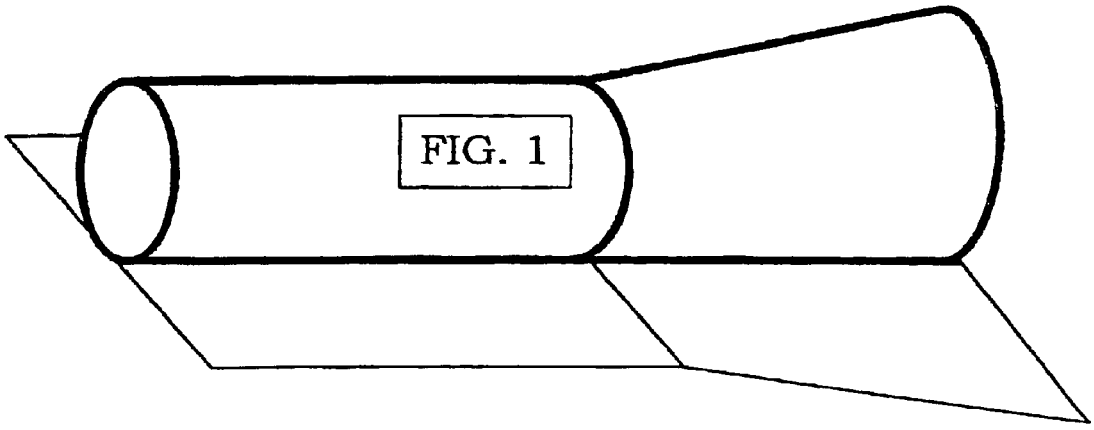
FIG. 1 shows a pipe section produced by rolling up a flat sheet which is suitable for a B pillar* or a front rail* or a rear rail*.
Figure 2:
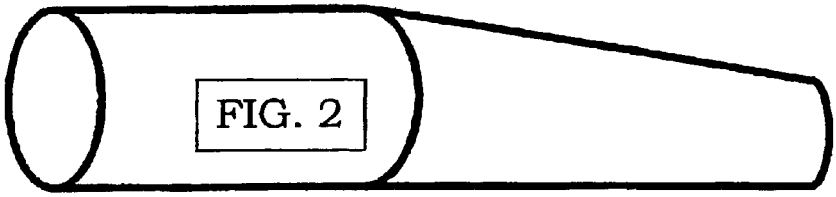
FIG. 2 shows the same.
Figure 3:
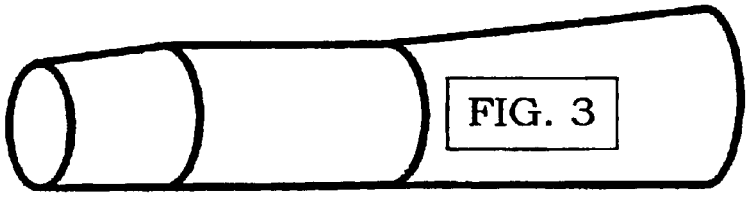
FIG. 3 is for a so-called shot gun.
Figure 4:
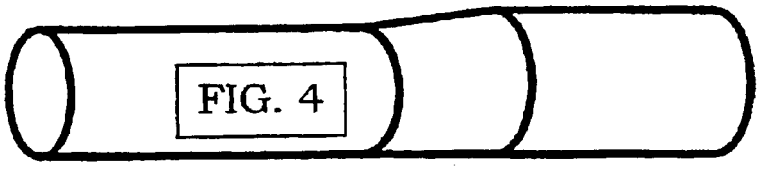
FIG. 4 is for a frame side member

FIG. 1 shows a pipe section produced by rolling up a flat sheet which is suitable for a B pillar* or a front rail* or a rear rail*;

FIG. 2 shows the same;

FIG. 3 is for a so-called shot gun;

FIG. 4 is for a frame side member*

Figure 5:
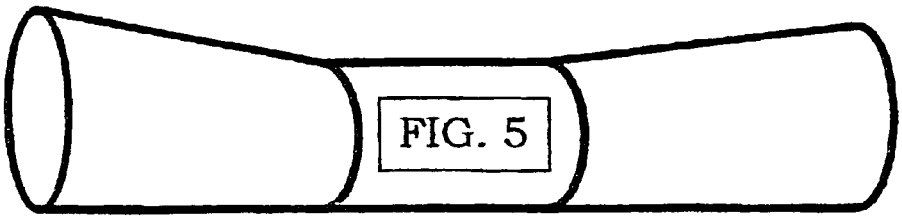
* FIG. 5 is for a seat frame* or a roof bow*.
Figure 6:
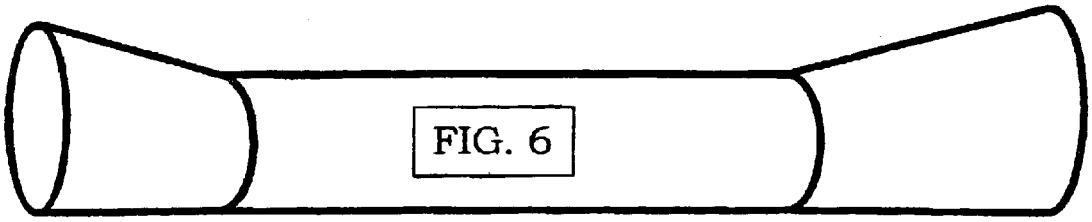
FIG. 6 shows the same.
Figure 7:
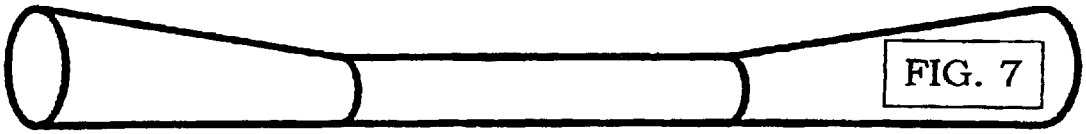
FIG. 7 shows the same.
Figure 8:
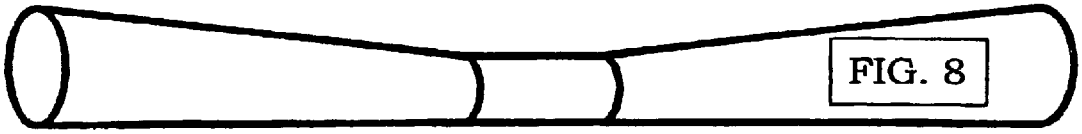
FIG. 8 shows the same.
Figure 9:
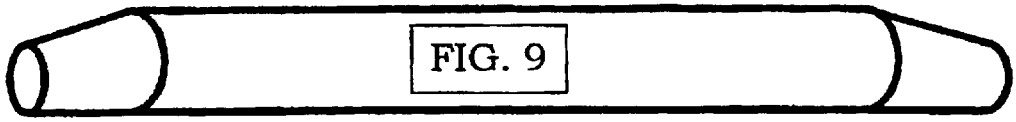
FIG. 9 is for a rail*

FIG. 5 is for a seat frame* or a roof bow*;

FIG. 6 shows the same;

FIG. 7 shows the same;

FIG. 8 shows the same;

FIG. 9 is for a rail*

Figure 10:
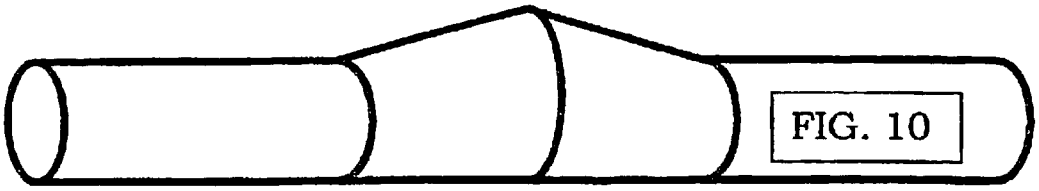
FIG. 10 is for a differential*.

FIG. 10 is for a differential*.

*Expression for an automotive part

The figures clearly show what type of pipe sections for hydroforming it will be possible to achieve by starting from a flat sheet which has the shape and properties of the desired pipe section but in the form of an opened-out blank and by rolling up this blank, as it were, and making it into a continuous, hydroformable pipe section.

What is claimed is:

1. Process for producing a tubular component having, over at least part of its length, a widening or tapering section comprising the steps of:

joining together flat sheet parts which differ from one another, at least one of the sheet parts being trapezium-shaped, bringing together opposite edges of the joined sheet parts and joining the edges in such a manner that the tubular component formed in this way can be hydroformed, and hydroforming the component.

2. Process according to claim 1, wherein the joining is laser welding.

3. Process according to claim 2, wherein a first joining seam between the sheet parts formed by joining runs in such a manner that an angle included between an imaginary line through the start and end of the first joining seam and the axis about which it has been rolled is not zero.

4. Process according to claim 3, wherein the first joining seam joining together the flat sheet parts and a second joining seam created by joining together the opposite edges of the joined sheet parts do not intersect each other at one point.

5. Process according to claim 2, wherein the first joining seam joining together the flat sheet parts and a second joining seam created by joining together the opposite edges of the joined sheet parts do not intersect each other at one point.

6. Process according to claim 2, wherein the first joining seam joining together the flat sheet parts and a second joining seam created by joining together the opposite edges of the joined sheet parts do not intersect each other at only one point.

7. Process according to claim 2, wherein the first joining seam joining together the flat sheet parts and a second joining seam created by joining together the opposite edges of the joined sheet parts intersect at two points.

8. Process according to claim 2, wherein the start and end of the first joining seam joining together the flat sheet parts do not intersect each other at one point after forming the second seam.

9. Process according to claim 1, wherein a first joining seam between the sheet parts formed by joining runs in such a manner that an angle included between an imaginary line through the start and end of the first joining seam and the axis about which it has been rolled is not zero.

10. Process according to claim 9, wherein the first joining seam joining together the flat sheet parts and a second joining seam created by joining together the opposite edges of the joined sheet parts do not intersect each other at one point.

11. Process according to claim 1, wherein the first joining seam joining together the flat sheet parts and a second joining seam created by joining together the opposite edges of the joined sheet parts do not intersect each other at one point.

12. Process according to claim 1, wherein the first joining seam joining together the flat sheet parts and a second joining seam created by joining together the opposite edges of the joined sheet parts do not intersect each other at only one point.

13. Process according to claim 1, wherein the first joining seam joining together the flat sheet parts and a second joining seam created by joining together the opposite edges of the joined sheet parts intersect at two points.

14. Process according to claim 1, wherein the start and end of the first joining seam joining together the flat sheet parts do not intersect each other at one point after forming the second seam.

15. Process according to claim 1, wherein the sheet parts differ from one another in one or more of the group consisting of material, size and thickness.

* * * * *